United States Patent [19]

Kankkunen

[11] 4,452,430

[45] Jun. 5, 1984

[54] SAFETY DEVICE FOR LOWERING PERSONS AND LOADS

[76] Inventor: Matti K. Kankkunen, Yliskyläntie 5 B 11, SF-00840 Helsinki 84, Finland

[21] Appl. No.: 352,219

[22] Filed: Feb. 25, 1982

[30] Foreign Application Priority Data

Mar. 3, 1981 [FI] Finland ..... 810661
Mar. 3, 1981 [FI] Finland ..... 810662

[51] Int. Cl.[3] ..... A62B 1/12; B66D 1/28

[52] U.S. Cl. ..... 254/391; 182/233; 182/238; 242/99; 254/377

[58] Field of Search ..... 254/267, 377, 391, 379, 254/901; 242/99, 107.3; 182/233, 236–238

[56] References Cited

U.S. PATENT DOCUMENTS

| | | | |
|---|---|---|---|
| 2,873,055 | 2/1959 | Hill | 254/377 X |
| 3,504,891 | 4/1970 | Ulbing | 254/379 |
| 3,861,496 | 1/1975 | Hoover | 182/233 |
| 3,879,016 | 4/1975 | Kankkunen | 242/99 |
| 3,907,256 | 9/1975 | Kankkunen | 242/107.3 |
| 4,173,332 | 11/1979 | DuLondel | 254/391 |
| 4,359,139 | 11/1982 | Bloder | 182/238 X |

FOREIGN PATENT DOCUMENTS 13168 2/1929 Finland .
42164 5/1970 Finland .

*Primary Examiner*—John Petrakes
*Attorney, Agent, or Firm*—Pennie & Edmonds

[57] ABSTRACT

A safety device for lowering persons and loads comprises a two-piece casing, the two halves of which are symmetrical forming a cylinder therebetween, in which a piston provided with flow channels for a medium is fitted to move axially, the circumference of the piston having a sinusoidal groove in which are engaged one or several pins which are moved by a cable drum which is rotated by the cable around the outer circumference of the cylinder and in which there is a guide roll arrangement for the cable or rope, both ends of the cable hanging freely and one of them being loaded. The arrangement may further comprise three guide rolls with both ends of the cable passing over the central roll on opposite sides of it and then between it and one of the other guide rolls on either side of it, so arranged that the loaded cable presses the central guide roll against the unloaded part of the cable which is thereby pressed against one of the guide rolls producing an additional braking effect by friction. The arrangement may also comprise, outside the casing an adjustable regulator for throttling the flow of the medium in order to adjust the rate of descent to that desired.

12 Claims, 10 Drawing Figures

Figure 1:
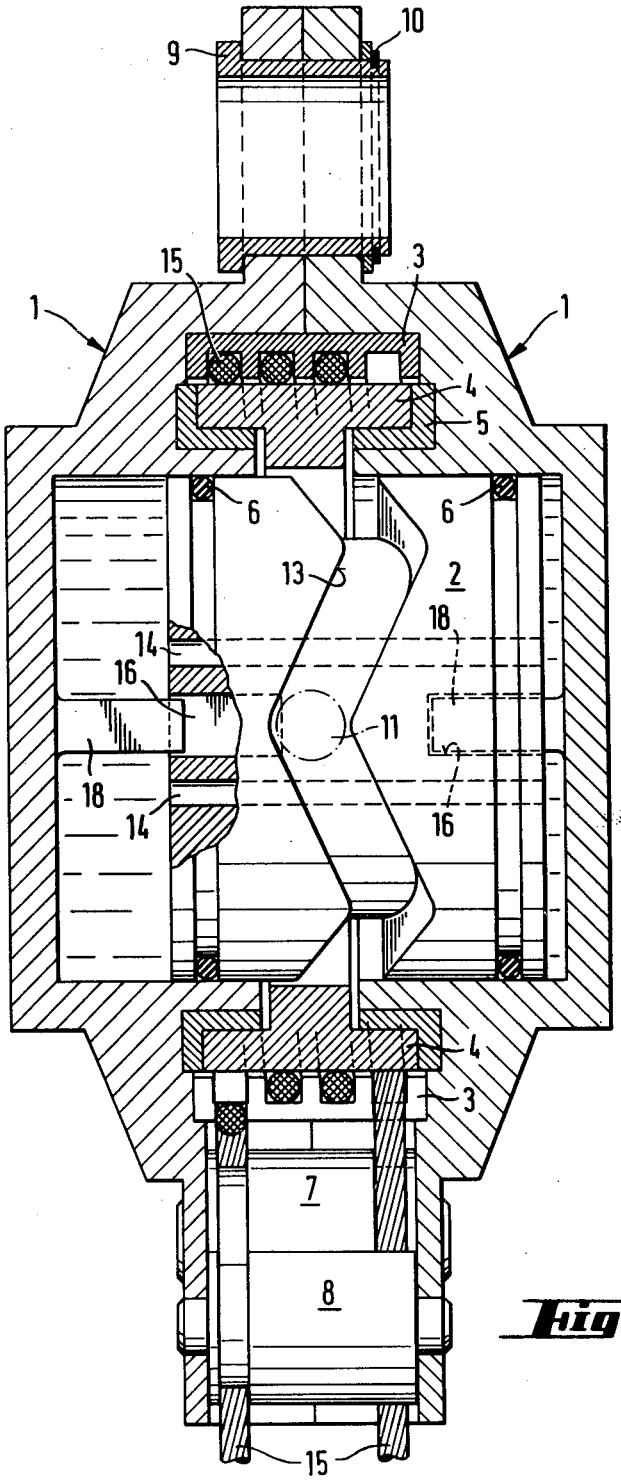

9
1
15
3
5
4
14
2
16
14
7
8
8
1
15
15

9
1
15
3
5
4
14
16
2
14
7
8
8
1
21
15
15

SAFETY DEVICE FOR LOWERING PERSONS AND LOADS

BACKGROUND OF THE INVENTION

1. Field of the Invention

The present invention relates to a safety device and in particular to a device for lowering persons or diverse goods from high places. Such safety devices, including the object of the present invention, generally comprise a cable drum around which a cable or rope is wound and to an end of which cable or rope is fastened the person or load. As it turns the cable drum is braked hydraulically or pneumatically to reduce the rate of descent.

2. Description of the Prior Art

As a backgound against which to evalute the new main principles of the present invention reference may be made to the specification of U.S. Pat. No. 3,907,256 in which one such safety device is described. A characteristic of devices of this kind is a rotating cylinder which is adjustably coupled to the cable drum when the speed of said drum is sufficiently high. The clinder is mounted on a body and it contains a central piston, which is fixed to the cylinder and acts as a partition dividing the cylinder into two chambers. The device additionally has two rotating pistons and end walls to the cylinder. THe end walls of the cylinder and all the pistons have a "wavy" form. The safety device of this patent is further characterized in that it has one cylinder which is closed and filled with a fluid, and when the device is in operation flow of said fluid takes place on both sides of said central fixed piston from one side to the other.

Whatever the merits of the aforesaid known safety device are, it also has some serious drawbacks. In particular, because one of the main principles of its operation is the flow of fluid from one side to the other of the "wavy" shaped pistons, these pistons as a consequence of their special shape are not tight. Because of this lack of tightness of the pistons and also of the axle which passes through the whole cylinder, it is not possible to determine with certainty the exact rate of descent which will be provided by the device. Secondly, the rapid motion of the pistons causes a change in the viscosity of the fluid, which in turn causes a reduction in the braking effect of the fluid and thereby an increase in the rate of descent. Moreover, the rapid motion of the pistons causes appreciable wear in them, so that in hard use there is an evident danger of seizure. Further, the replacement of valves by orifices, which was characteristic of the previously mentioned device, requires the use of thick oils for the fluid of the braking mechanism and this in turn makes the device dependent on weather conditions.

Another known safety device is that described in U.S. Pat. No. 4,173,332 which differs from that described above in that the cylinder is fitted with only one piston, said piston being a close fit in the cylinder and moving back and forth in an axial direction, which axial motion is brought about by means of the interaction of a sinusoidal groove around the circumference of the rotating piston and pins fitted to the fixed cylinder so as to engage in said sinusoidal groove. The operation of the device is similar to that of the device described previously and its drawbacks are also the same.

SUMMARY OF THE INVENTION

The present invention provides a safety device for lowering persons and loads, which comprises

- a casing constituted by two parts forming cylinder halves;
- a cable drum rotatably fitted inside the casing;
- a piston fitted into the cylinder so as to move in its axial direction only;
- flow channels associated with the piston to enable flow of a fluid medium from one side to another of the piston;
- a groove of approximately sinusoidal form provided around the circumference of the piston; and
- at least one pin provided on the cable drum to be engaged in said groove in the piston so as to cause resiprocating movement of the piston within the cylinder when the cable drum rotates.

Thus, in the construction according to the present invention only one piston is used and it is constrained to move in an axial direction only back and forth within a fixed cylinder, each end of said piston being sealed by an "O" ring or a metal ring. Midway along the cylinder there is a slot encircling its whole circumference through which slot two or more pins project into the cylinder, said pins being fixedly attached to a cable drum which is fitted to turn about the outside of the cylinder and engaging in a sinusoidal groove around the circumference of the piston thereby, as they move, imparting to said piston its reciprocating motion.

In prior known safety devices in order that the rate of descent provided by them can, for various reasons, be changed, it has been necessary to remove and replace the valves in those channels through which the fluid medium flows, either through the piston from one end of the cylinder to the other or else directly out to the exterior of the cylinder. Such exchange of values has naturally to be carried out when the safety device is not in use and in addition requires a considerable amount of various installation work.

In the device according to the present invention provision is made for adjustment by conducting the medium from one side of the piston to the other along an external channel in which is fitted a regulating valve, by opening or throttling which valve the rate of descent can be adjusted. It is also possible, if air is used as the medium, to fit a lever outside the casing by means of which lever valves in both ends of the cylinder can be adjusted simultaneously.

It is a purpose of the invention to avoid the difficulties and drawbacks associated with the prior art as described above.

An additional purpose of the present invention is to provide an improved guide roll arrangement which improves safety by increasing the braking power of the safety device and also keeps the surface of the cable smooth.

The arrangement according to an embodiment of the invention is suitable for use in safety devices in which the cable is trained only one or a few turns around the cable drum with both ends of the cable hanging freely downwards from the drum, as is described, for xample, in U.S. Pat. No. 4,173,332. It comprises three guide rolls, with both free parts of the cable being trained over the central guide roll and with each of the free parts of the cable passing over different guide rolls, the two guide rolls being located on either side of the central guide roll and so arranged that under the action of the loaded part of the cable the central guide roll is pressed against the other, unloaded, part of the cable.

Further details and advantages of the invention will be explained in detail below with reference to the accompanying drawings.

Figure 2:
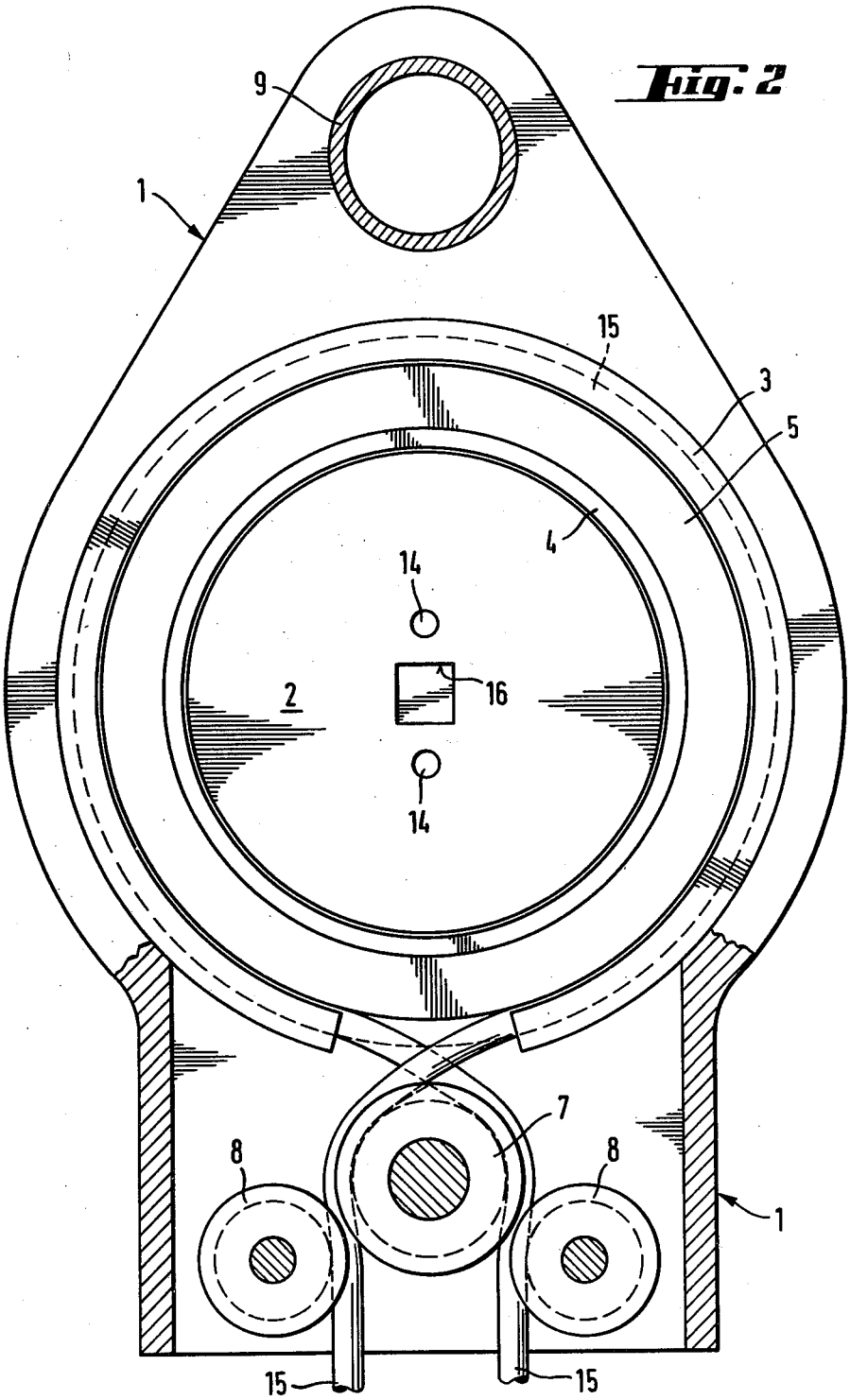
Figure 3:
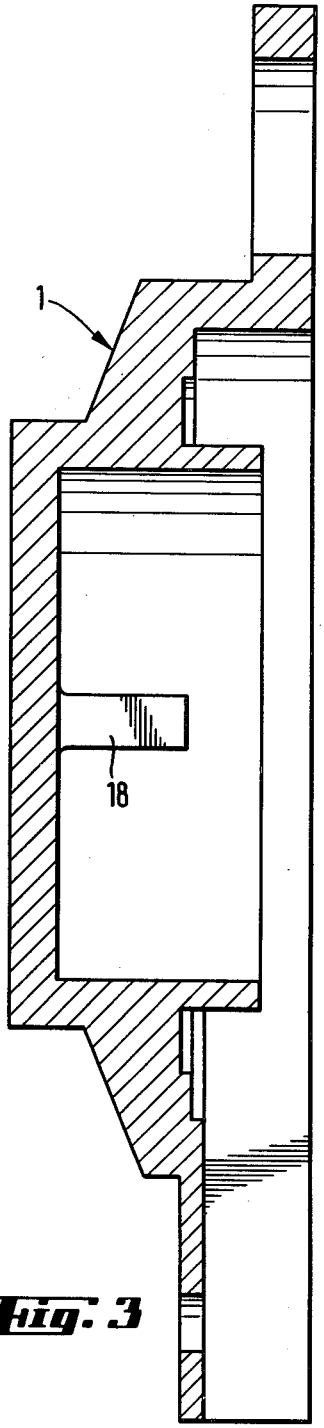
Figure 4:
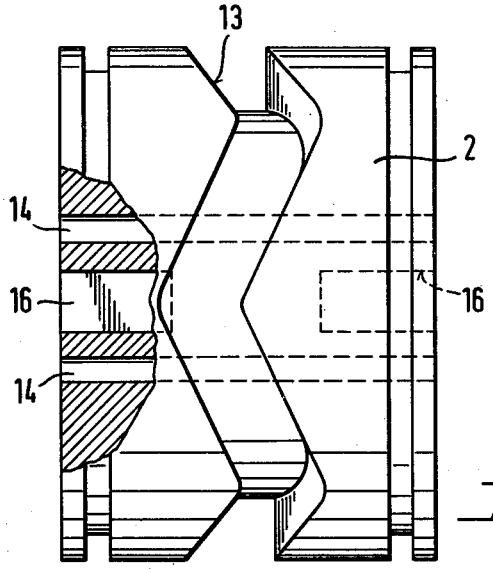
Figure 5:
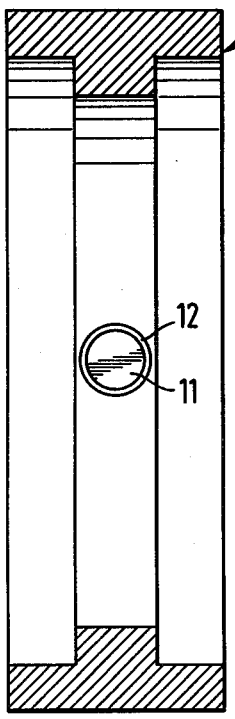
Figure 6:
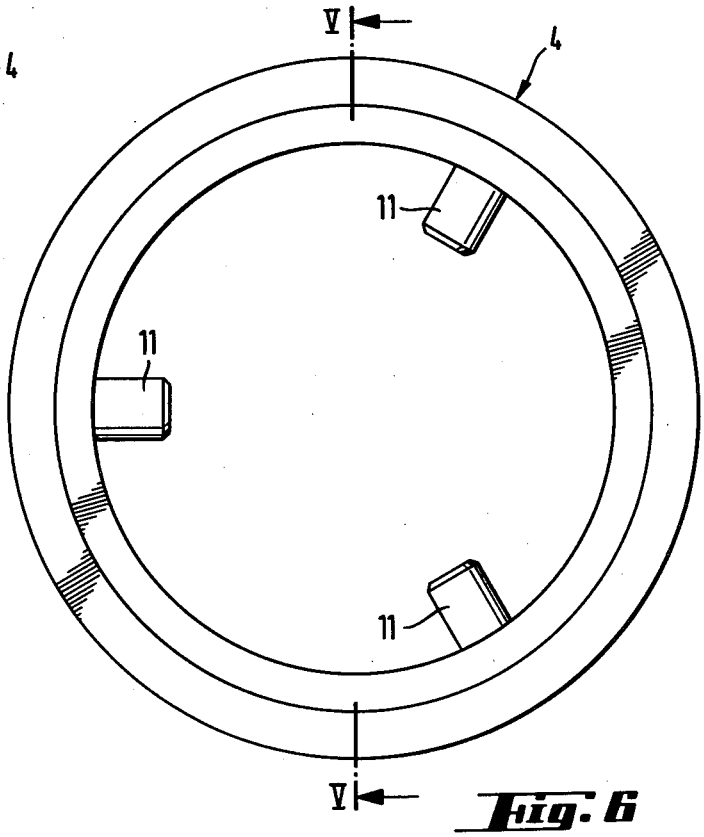
Figure 7:
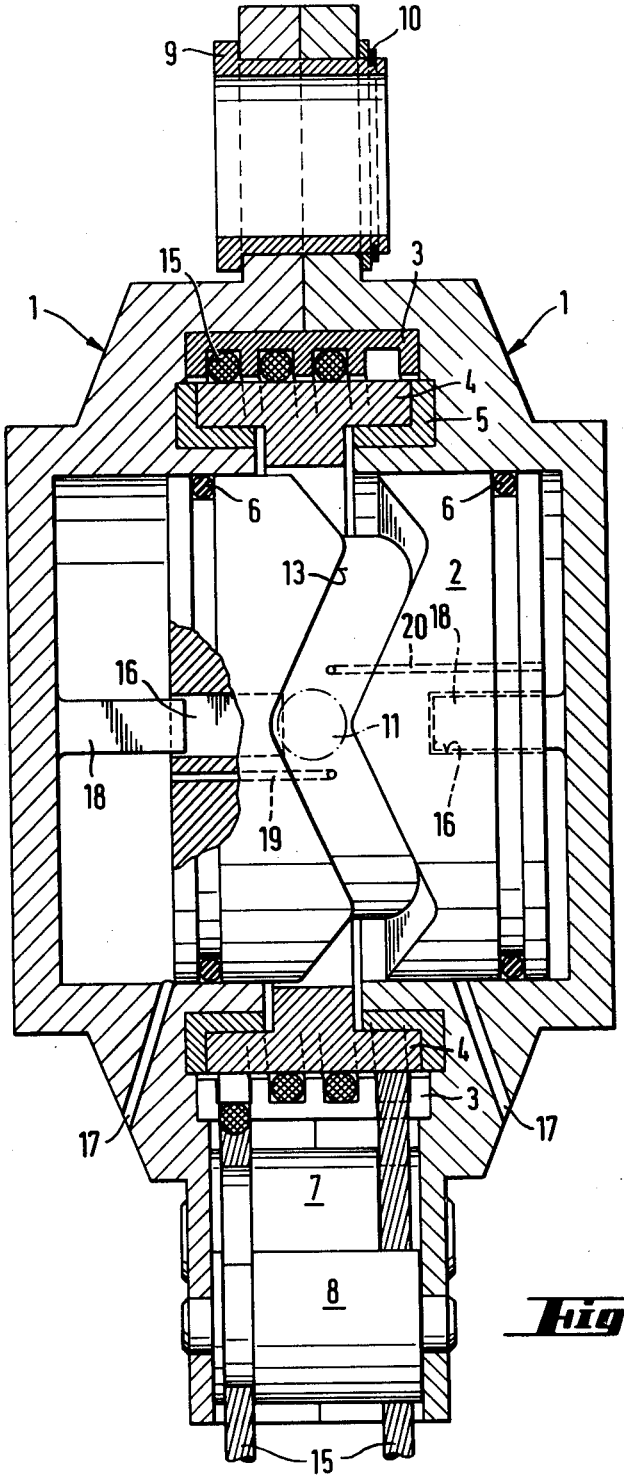
Figure 8:
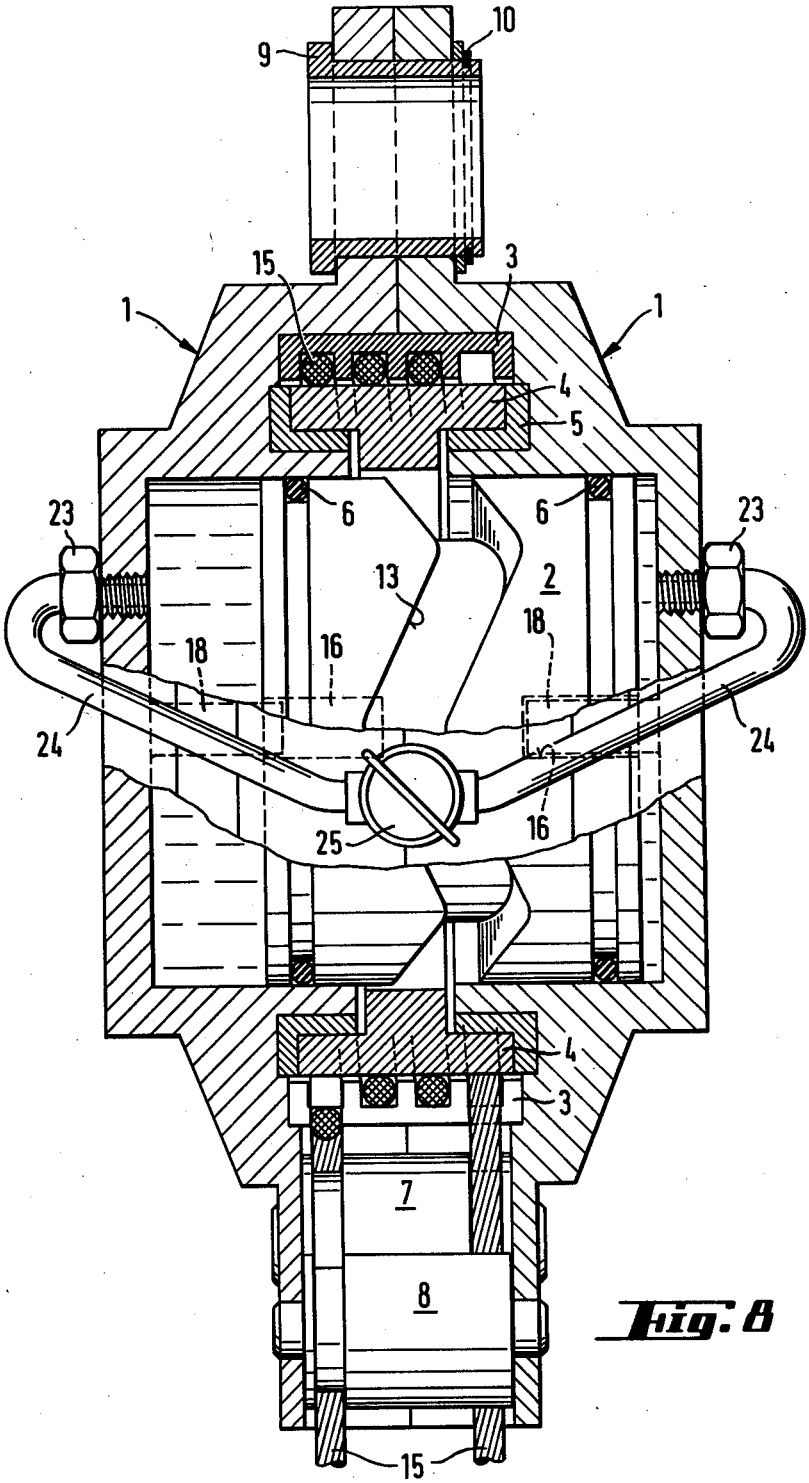
Figure 9:
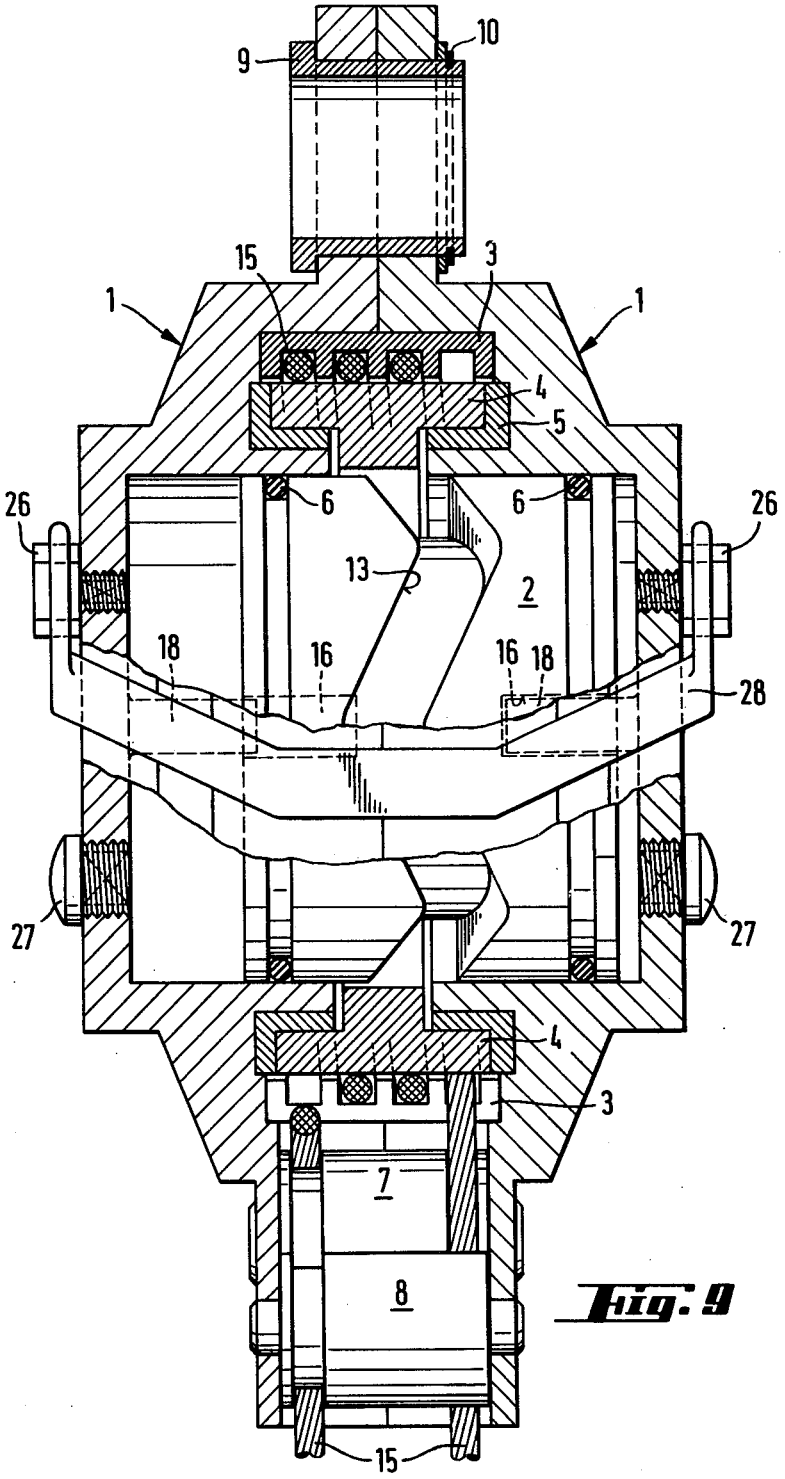
Figure 10:
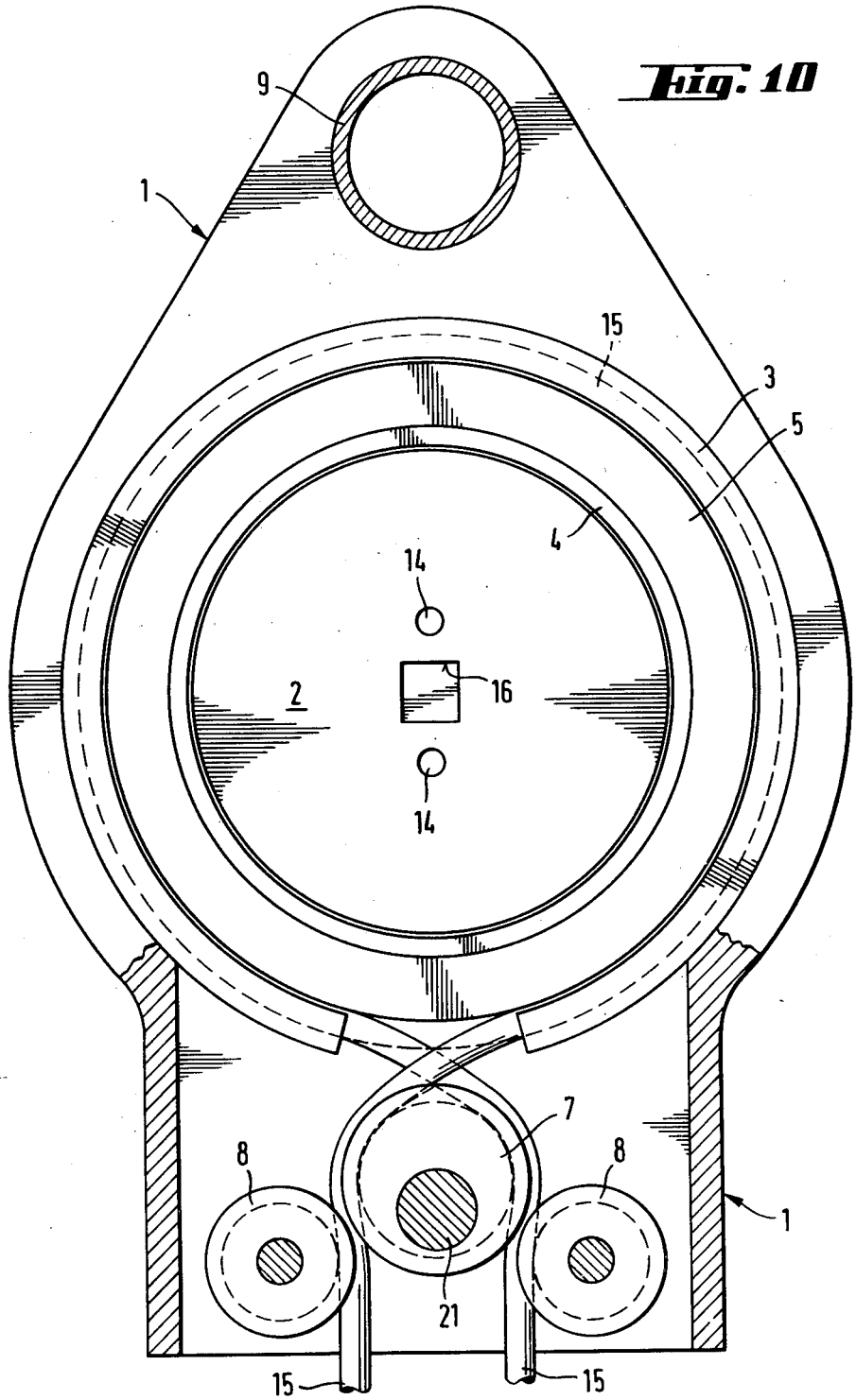

FIG. 1 illustrates a section of one embodiment of the invention in the direction of the axle, FIG. 2 a partially broken-away side view perpendicular to the axle, FIG. 3 a section of one half of the cylinder and casing, FIG. 4 a side view of the piston, FIG. 5 a longitudinal section of the cable drum and FIG. 6 an end view of the cable drum, FIG. 7 a section in the direction of the axle of another, pneumatically acting embodiment, FIG. 8 one arrangement for regulating the rate of descent, FIG. 9 another arrangement for regulating the rate of descent, and FIG. 10 a guide roll arrangement for the cable.

In the drawings the reference number 1 denotes the casing of the safety device, which casing also forms the two halves of the cylinder, 2 is a piston which moves in an axial direction only within the cylinder, 3 is a guide spiral for the cable, 4 is a cable drum which rotates under the action of the cable 15 about plain bearings 5, 6 denotes "O" rings in the piston, 7 and 8 are guide rolls for the cable, 9 is an attachment bolt, 10 a retaining ring, 11 is a pin fixed to the cable drum and which controls the motion of the piston, 12 is a roller bearing for pin 11, 13 is a camming groove of e.g. sinusoidal form around the central circumference of the piston, and 14 valve are channels passing through the piston in which may be fitted various interchangeable orifices thereby enabling various fixed rates of descent to be chosen. Small orifices permit the use of the thinnest liquids, such as brake fluid, which in turn makes the device less sensitive to changes in weather conditions.

The safety device may also be made to work pneumatically, as is illustrated in FIG. 7, in which the cylinder is equipped with air-intake channels 17 and the piston with air-outlet channels 19 and 20, which outlet channels open into the sinusoidal groove 13 and can be fitted with interchangeable orifices.

When a load is applied to one end of the cable 15 in the device of FIG. 1, it causes the cable drum 4 to rotate and with it the pin or pins 11, which being engaged in the sinusoidal groove in the circumference of the non-rotating piston force the piston 2 to move back and forth, thereby forcing a liquid in the cylinder to flow through the small orifice in the channel 14 to the opposite side of the piston, thereby braking the rotation of the cable drum and thus the descent of the load. In order to prevent rotation of the piston, grooves 16 are cut in each end of it, said grooves engaging with plate-formed projections 18 fixed at each end of the cylinder.

The pneumatic embodiment illustrated in FIG. 7 differs somewhat in its operation compared with the hydraulic embodiment described above.

In this embodiment when the piston 2 is in the extreme rightward position the air-inlet channel 17 at the left end of the cylinder is opened and the cylinder fills with air. When the piston begins to move again the channel is closed by the piston and the air begins to force its way through the small orifice and the channel 19 in the piston, exiting through the outlet fitted to the groove 13. At the same time a partial vacuum is formed on the right side of the piston, which partial vacuum has an additional braking effect on the motion of the piston. A non-return valve may also be fitted to each channel 17 to prevent the flow of air through the channel out of the cylinder space providing additional braking. The flow of air past the piston is effectively prevented by the "O" rings fitted at both ends of the piston. When the piston has reached the extreme leftward position the process described above is repeated at the opposite end of the cylinder, air entering the right end of the cylinder and exiting through the channel 20.

In FIGS. 8 and 9 the reference number 23 denotes a flow orifice for the medium, 24 is a flow channel for the medium, 25 a flow regulating valve, 26 adjustable air outlet valves, 27 air inlet valves or non-return valves, and 28 a regulating lever controlling both outlet valves.

In FIG. 10 the reference number 1 denotes the casing or body, of which there are two identical pieces in the device, one half having been removed in the drawing to show the internal parts. The reference number 3 denotes a guide spiral for the cable which guides the cable on the cable drum 4 when it is wound more than one turn around the drum, 5 is a plain bearing ring between the cable drum 4 and the wall of the fixed cylinder half of the casing 1, 7 and 8 are guide rolls for the cable 15, 9 is a hole from which the safety device can be suspended or otherwise attached, and 21 is the axle of the central guide roll.

In this type of safety device either end of the cable may be that to which the load is attached provided only that the end that is loaded is the end nearest the device, i.e. that which is uppermost. Accordingly the two ends may be used alternately. As will be seen from FIG. 10, the two ends of the cable pass on opposite sides of roll 7, the axle 21 of which is fitted eccentrically displaced downwards towards the rolls 8. When a load is applied to one of the free ends of the cable 15 the loaded part of the cable acts on roll 7 pressing it towards the other part of the cable. The latter part is thereby pressed against the guide roll 8 over which it passes, whereby the friction between the roll 7 and the free, unloaded part of the cable is increaased, braking the motion of the part of the cable which is travelling in an upwards direction. Moreover since this part of the cable is powerfully pressed between the rolls 7 and 8 its surface is smoothed, especially if it contains any broken strands.

If it is desired that the guide roll 7 is free to turn, in which case the braking effect is naturally somewhat reduced, the axle 21 can be fitted concentrically to roll 7, as in FIG. 2. The axle is mounted on the body by conventional means in such a manner that it is free to move in lateral and/or vertical direction, whereby a similar powerful compression of the rising section of the cable between rolls 7 and 8 can be achieved while avoiding the wear caused by sliding friction between the roll 7 and the cable.

In trials carried out with a safety device according to the present invention a load of two large men was lowered at a very safe and even rate from a height of approximately 10 meters in several consecutive trials.

The invention is not restricted to the embodiments described in the foregoing and illustrated in the drawings, but may be modified within the limits of the following patent claims. 9n

What is claimed is:

1. A safety device for lowering persons and loads, which comprises a casing defining a cylindrical cavity;

a cable drum rotatably mounted on the casing for rotation about the longitudinal axis of the cylindrical cavity, and for holding a cable wound on the drum, said drum being adapted to rotate about said axis in response to tension on the cable due to the weight of persons and loads being lowered thereon;

a piston fitted into the cylindrical cavity so as to be free to move parallel to the longitudinal axis of the cavity only;

flow channels connecting one side of the piston to the other to enable flow of a fluid medium therebetween;

a groove of approximately sinusoidal form extending about the outer circumferential surface of the piston; and at least one pin connected to the cable drum for rotation therewith about said outer circumferential surface of said piston, and said pin being engaged in said groove in said piston so as to cause reciprocating movement of the piston within the cavity when the cable drum rotates in response to said tension on the cable.

2. A safety device according to claim 1, wherein the fluid medium is air, said flow channels comprise two air inlet channels extending through the casing near the ends of said cavity, each inlet channel being located to expose the cavity to the ambient atmosphere when said piston is in its extreme position in the cavity away from said channel, in which extreme position said piston blocks the other of said inlet channels, and said flow channels further comprise two other smaller air outlet channels connecting opposite ends of the cavity to the ambient atmosphere

3. A safety device according to claim 2, wherein the air outlet channels are arranged to lead from each end of the piston, through the piston, and into the groove.

4. A safety device according to claim 2, wherein the air outlet channels are arranged to pass through the end walls of the cavity.

5. A safety device according to claim 4, further comprising an exterior air channel outside said casing joining said two air outlet channels, said exterior channel having therein a flow regulating valve for controlling the flow of air between said air outlet channels.

6. A safety device according to claim 4, further comprising adjustable valve means in each of said air outlet channels, and means for simultaneously adjusting both of said adjustable valve means.

7. A safety device according to any one of claims 2–4, 5, or 6, wherein said air inlet channels have therein non-return valves which permit the inlet of air but prevent the flow of air out of said cylinder through said air inlet channels.

8. A safety device according to claim 1, wherein said fluid medium is a liquid.

9. A safety device according to any one of claims 1–4, 5, or 6, further comprising one central and two lower guide rolls for a cable supported by said cable drum, the axes of the central and lower guide rolls being parallel to the axis of said cable drum and forming a triangular arrangement thereunder, such that a first end of said cable depending from a first side of the cable drum is trained over the opposite side of the central guide roll and over the side of a respective one of said lower guide rolls nearest said first side, said central guide roll further being mounted so as to be moved by the tension in said cable in a direction generally toward said first side, thereby moving another end of said cable against the lower guide roll on said first side to create friction between said cable and said lower guide roll on said first side.

10. A safety device according to claim 9, wherein said mounting of said central guide roll is on an eccentric axle below the longitudinal axis of said central guide roll.

11. A safety device according to claim 9, wherein said mounting of said central guide roll is on a concentric axle, said axle being movable by said cable tension with respect to said lower guide rolls.

12. A safety device according to claim 1, wherein said cable drum has a guide spiral for spirally guiding the winding of said cable on said drum.

* * * * *